US006710747B1

(12) United States Patent
Chang

(10) Patent No.: US 6,710,747 B1
(45) Date of Patent: Mar. 23, 2004

(54) MODULIZED ANTENNA SLEEVE

(75) Inventor: Hui-Tsang Chang, Kan Ting Hsiang (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 10/302,013

(22) Filed: Nov. 22, 2002

(51) Int. Cl.[7] ..... H01Q 1/24; H01Q 1/50
(52) U.S. Cl. ..... 343/702; 343/906
(58) Field of Search ..... 343/702, 906, 343/713, 715, 711; 439/916; H01Q 1/24, 1/50

(56) References Cited

U.S. PATENT DOCUMENTS 6,339,401 B2 * 1/2002 Oshiyama ..... 343/702
6,518,928 B1 * 2/2003 Sheu ..... 343/702
6,573,870 B1 * 6/2003 Chang ..... 343/702
6,639,561 B2 * 10/2003 Pruss et al. ..... 343/702

* cited by examiner

*Primary Examiner*—Hoanganh Le
(74) *Attorney, Agent, or Firm*—Harness, Dickey & Pierce, P.L.C.

(57) ABSTRACT

A modulized antenna sleeve is disclosed. The modulized antenna sleeve uses a pair of clipping hook elements to clip with the folded portion located the edge of a base hole of equipment housing, so as to be fixed on the equipment housing. Thereafter, an antenna can be inserted into the modulized antenna sleeve for being fixed on the equipment housing. The modulized antenna sleeve has a rotation-blocking element used for restricting the rotation of the antenna within a certain angle. The modulized antenna sleeve further has an asymmetrical design for enabling the installed rotation-blocking element to be located on a fixed direction with respect to the penetrating hole of the modulized antenna sleeve.

20 Claims, 11 Drawing Sheets

MODULIZED ANTENNA SLEEVE

FIELD OF THE INVENTION

The present invention relates to a modulized antenna sleeve, and more particularly, to the modulized antenna sleeve that can be used for installing an antenna on an equipment housing briefly and reliably.

BACKGROUND OF THE INVENTION

In the communication products, the main function of an antenna is to transmit and receive signals. The antenna fixed to the communication product often needs rotating so as to obtain the optimum efficacy of transmitting and receiving signals, and additionally, the antenna exposed is vulnerable to the external impact, and the production cost of the antenna and related components has to be greatly reduced for gaining the market competitiveness. Hence, the mechanism design for fixing an antenna to a communication product has to posses the features of endurance; no entanglement of the conductive wires connected to the antenna while the antenna is rotated; and low cost.

Referring to FIG. 1, FIG. 1 is a schematic diagram showing the assembly of the conventional antenna fixed to an equipment housing, wherein an antenna 10 is installed on an equipment housing 30 of a communication product via a metal cylindrical tube 20 used as an antenna holder formed on the sidewall of the equipment housing 30. While in mass production, the degree of tightness of the metal cylindrical tube 20 is not stable in quality and is not easy to meet the requirement of quality control, so that the metal cylindrical tube 20 and the equipment housing 30 are easy to be detached from the connection area thereof. Additionally, tolerating problems always exists in the production of every lot of metal cylindrical tubes, thus causing the inconsistent degree of tightness between the antenna and the metal cylindrical tube. Generally, the efficacy of tightness will be quite different even with only 0.1 mm difference of tolerance. Hence, the conventional metal cylindrical tube 20 has low production reliability. The antennas of different brands in the market have different sizes, and even the difference of about 0.1 mm would make the metal cylindrical tube fail to fit the antenna, and thus another metal cylindrical tube of different size needs to be used, therefore increasing the difficulty level of purchasing components.

Further, referring to FIG. 2, FIG. 2 is a schematic diagram showing the mechanism related to the rotation angle of the conventional antenna. After being installed on the equipment housing 30, the antenna 10 has to be rotatable but with being restricted generally to 180 degree of angle, or the conductive wires (not shown) connected to the antenna 10 would be entangled. However, the metal cylindrical tube 20 as shown in FIG. 1 does not have the rotation-limiting design, and thus a rib element 42 has to be added to the cover 40 to block a protrusion element 12 of an antenna connecting element 14 for preventing the antenna 10 from over-rotation, and yet the rib element 42 makes the communication product lack integrality of appearance.

Referring to FIG. 3, FIG. 3 is a schematic diagram showing the assembly of the other conventional antenna fixed to an equipment housing, wherein the other conventional antenna 10 is inserted into a plastic antenna-mounting hole 22 so as to be installed on the equipment housing 30 of the communication product. The plastic antenna-mounting hole 22 is formed on the sidewall of the equipment housing 30, and is fixed on the bottom of the equipment housing 30 by using a supporting foot 24*a* and a supporting foot 24*b*. However, the structure of the plastic antenna-mounting hole 22 is quite complicated, and the requirement for the precision of molding tools and processing is high, and further the mechanism for preventing the antenna 10 from over-rotation has to be designed additionally, so that it is very inconvenient in using and manufacturing the conventional plastic antenna-mounting hole 22.

It is worthy to be noted that, in accordance with different antenna products, different molding tools have to be made for manufacturing each of the aforementioned components, such as the metal cylindrical tube 20 shown in FIG. 1 or the plastic antenna-mounting hole 22 shown in FIG. 3. Hence, not only those components are not sharable in use, but also the development expense of the molding tools occupies a great portion of the total production cost thereof. Moreover, since the structure of the molding tools for manufacturing the plastic antenna-mounting hole 22 is complicated, the expense needed for these molding tools is even higher. With the addition of other processing costs, the metal cylindrical tube 20 and the plastic antenna-mounting hole 22 both do not have competition edge in the market.

Hence, there is an urgent need to develop a modulized antenna sleeve for promoting reliability, lower production cost, preventing the antenna from over-rotation and increasing sharable possibility, so as to overcome the shortcomings of the conventional metal cylindrical tube and plastic antenna mounting hole.

SUMMARY OF THE INVENTION

In view of the aforementioned background of invention, since the conventional metal cylinder tube and plastic antenna-mounting hole have the disadvantages of low reliability, high production cost and the communication product lacking integrality of appearance.

Therefore, it is an object of the present invention to provide a modulized antenna sleeve for promoting reliability; lowering production cost; and enhancing sharable possibility, etc., so that the modulized antenna sleeve is suitable for use in equipment housings (made of plastic or metal) of various thickness, and further the antenna installed can be prevented from over-rotation with maintaining the integrality of the appearance of the communication product.

In accordance with the aforementioned object, the present invention provides a modulized antenna sleeve used for installing an antenna on a base hole of an equipment housing, wherein at least one pair of folded portions are formed on the surrounding of the base hole, and the modulized antenna sleeve comprises: a hollow base member and a tubular main body located on a first surface of the hollow base member, wherein a through hole penetrates the hollow base member and the tubular main body, and the outer surface of the sidewall of the tubular main body has at least one pair of clipping hook elements, each of the clipping hook elements corresponding to each of the folded portions, each of the clipping hook elements comprising: a hook supporting portion, located on the first surface of the hollow base member, and on a second surface of the tubular main body adjacent to the first surface; and a hook portion, located on a surface of the hook supporting portion opposite to the first surface of the hollow base member, wherein the hook portion can be engaged with the folded portion. Moreover, the modulized antenna sleeve comprises: a rotation-blocking element, formed on a surface of the hollow base member opposite to the first surface, for restricting the rotation of the antenna within the range of an angle, wherein the antenna has a protrusion element, by which the antenna can stop rotating by the rotation-blocking element while the antenna is being rotated towards the aforementioned angle.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 4A, FIG. 4B and FIG. 4C are schematic diagrams showing the assembly of an antenna, an equipment housing and a modulized antenna sleeve of the preferred embodiment of the present invention, wherein FIG. 4A and FIG. 4B are viewed from different angles, and FIG. 4C is the schematic diagram showing a finished assembly;

DETAILED DESCRIPTION OF THE PREFERRED EMBODIMENT

Figure 1:
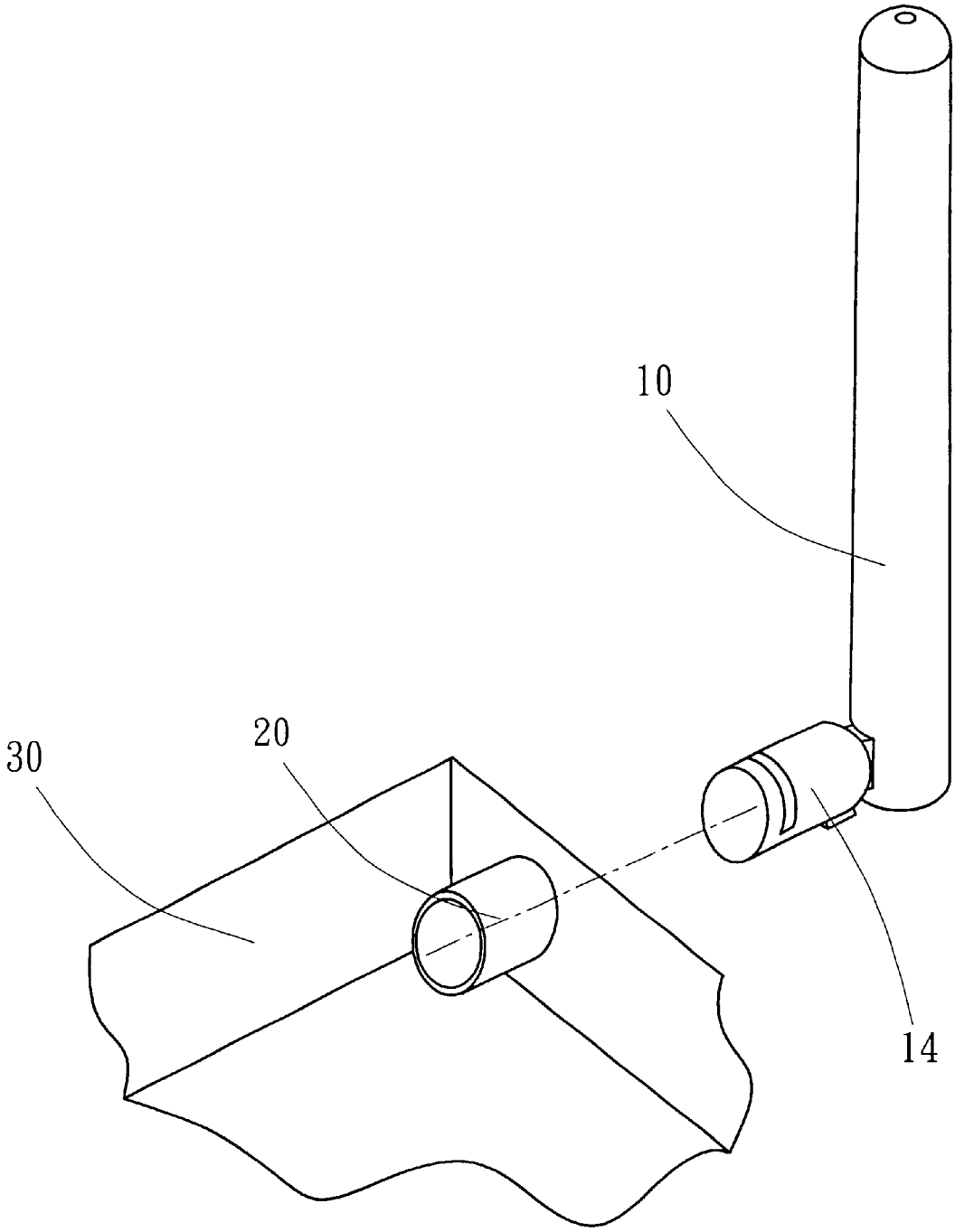
Fig. 1 (Prior Art)
FIG. 1 is a schematic diagram showing the assembly of a conventional antenna fixed to an equipment housing.
Figure 2:
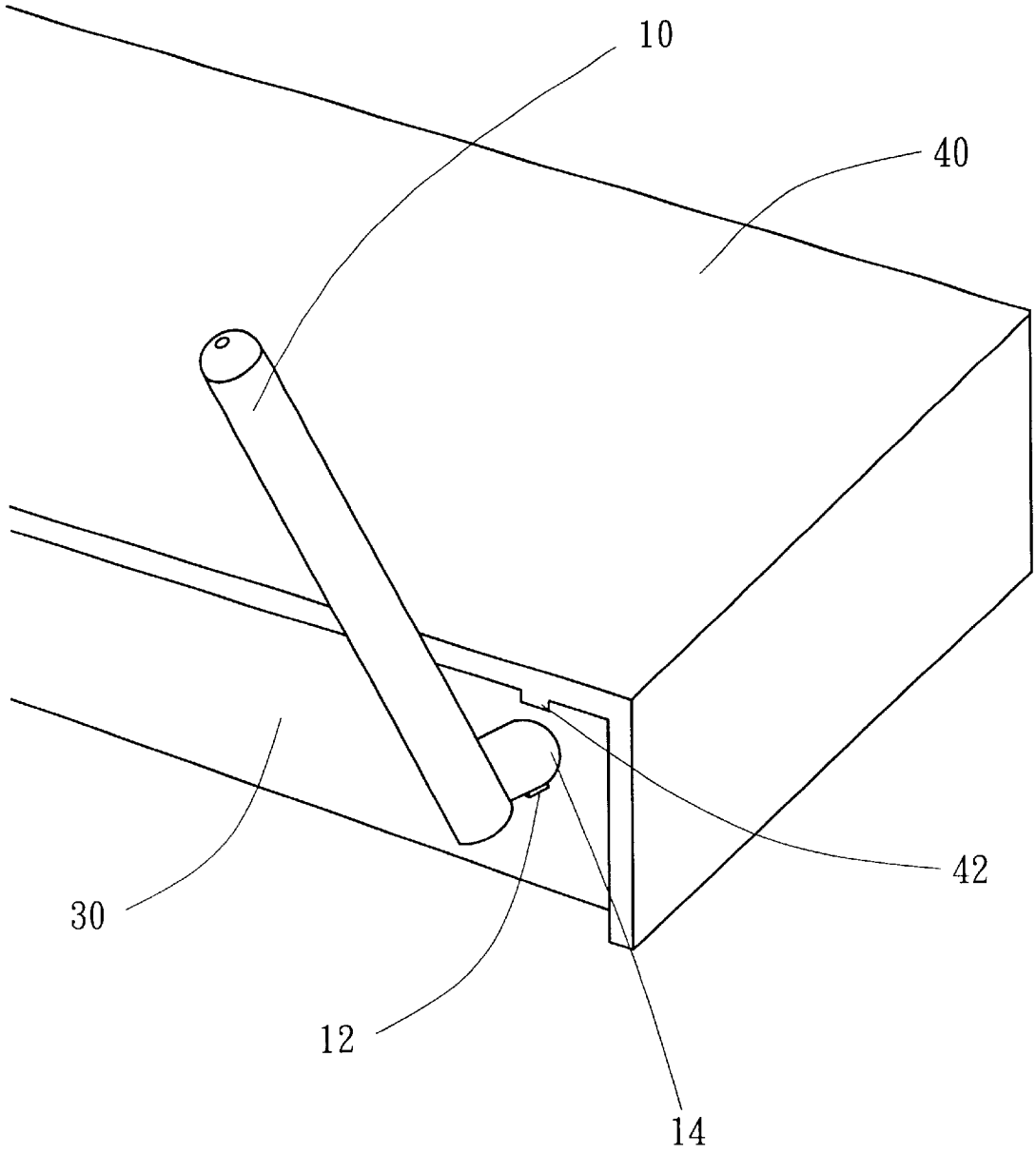
Fig. 2 (Prior Art)
FIG. 2 is a schematic diagram showing the mechanism related to the rotation angle of the conventional antenna.
Figure 3:
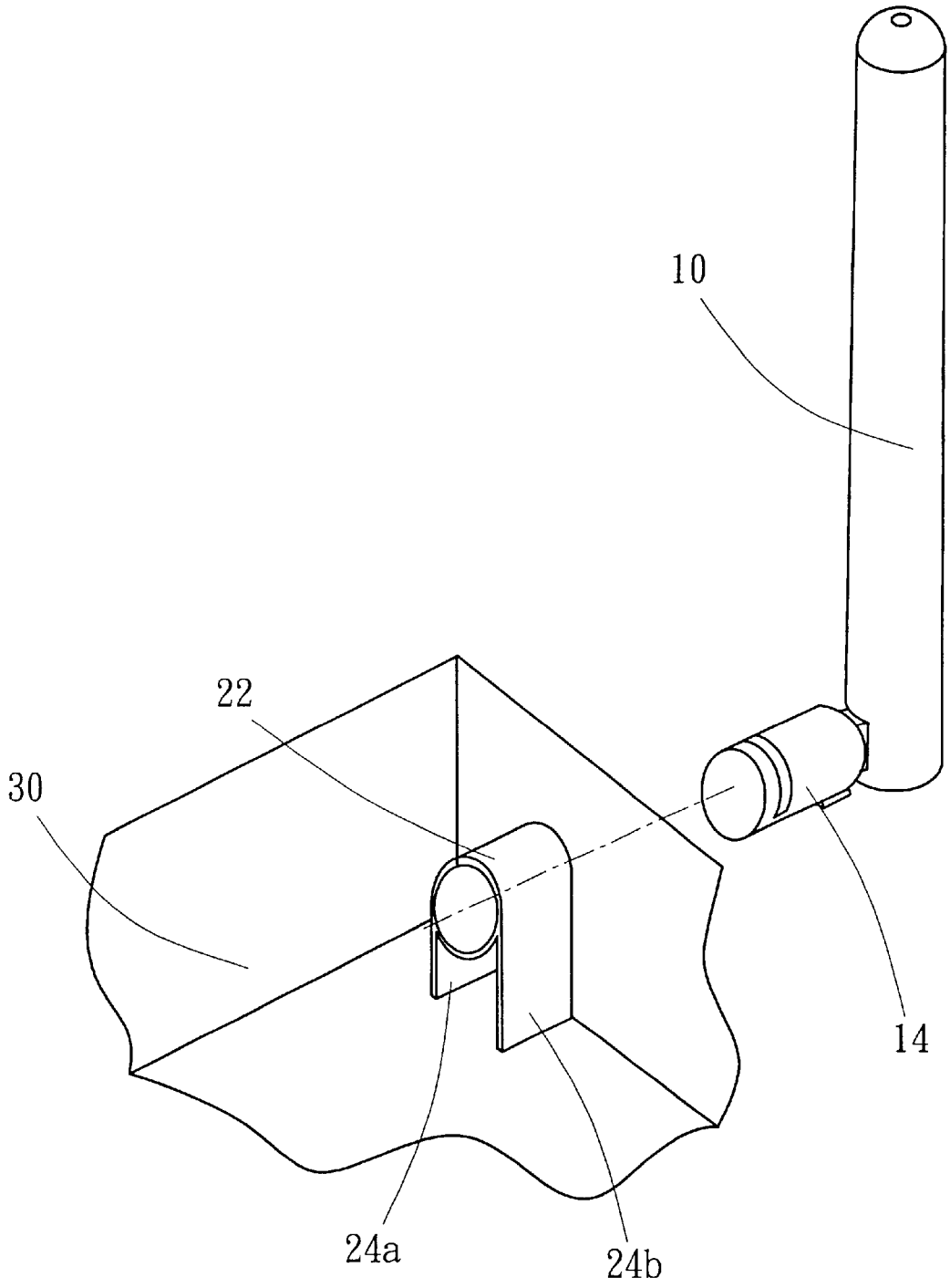
Fig. 3 (Prior Art)
FIG. 3 is a schematic diagram showing the assembly of the other conventional antenna fixed to an equipment housing.
Figure 4A:
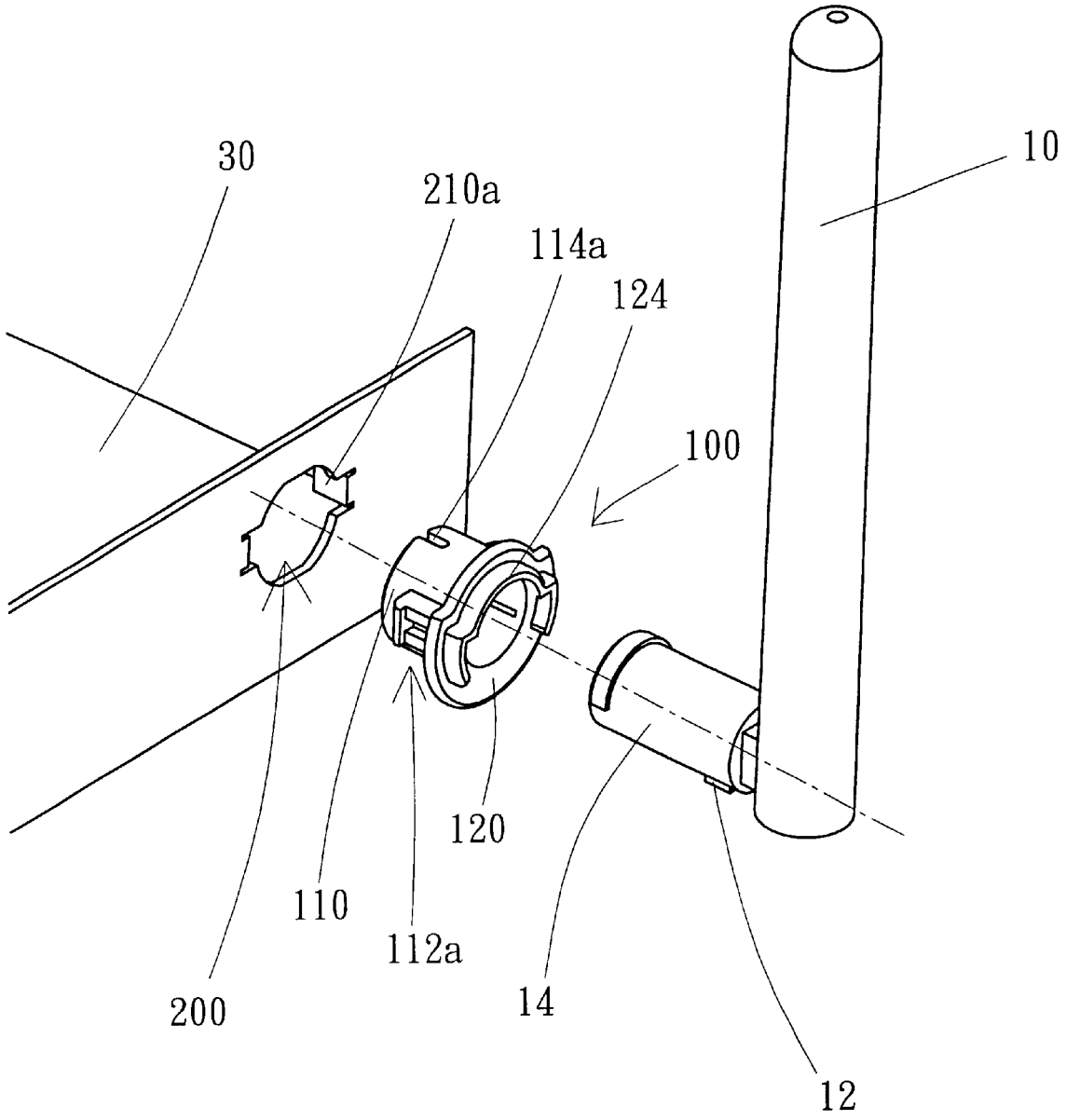
Figure 4B:
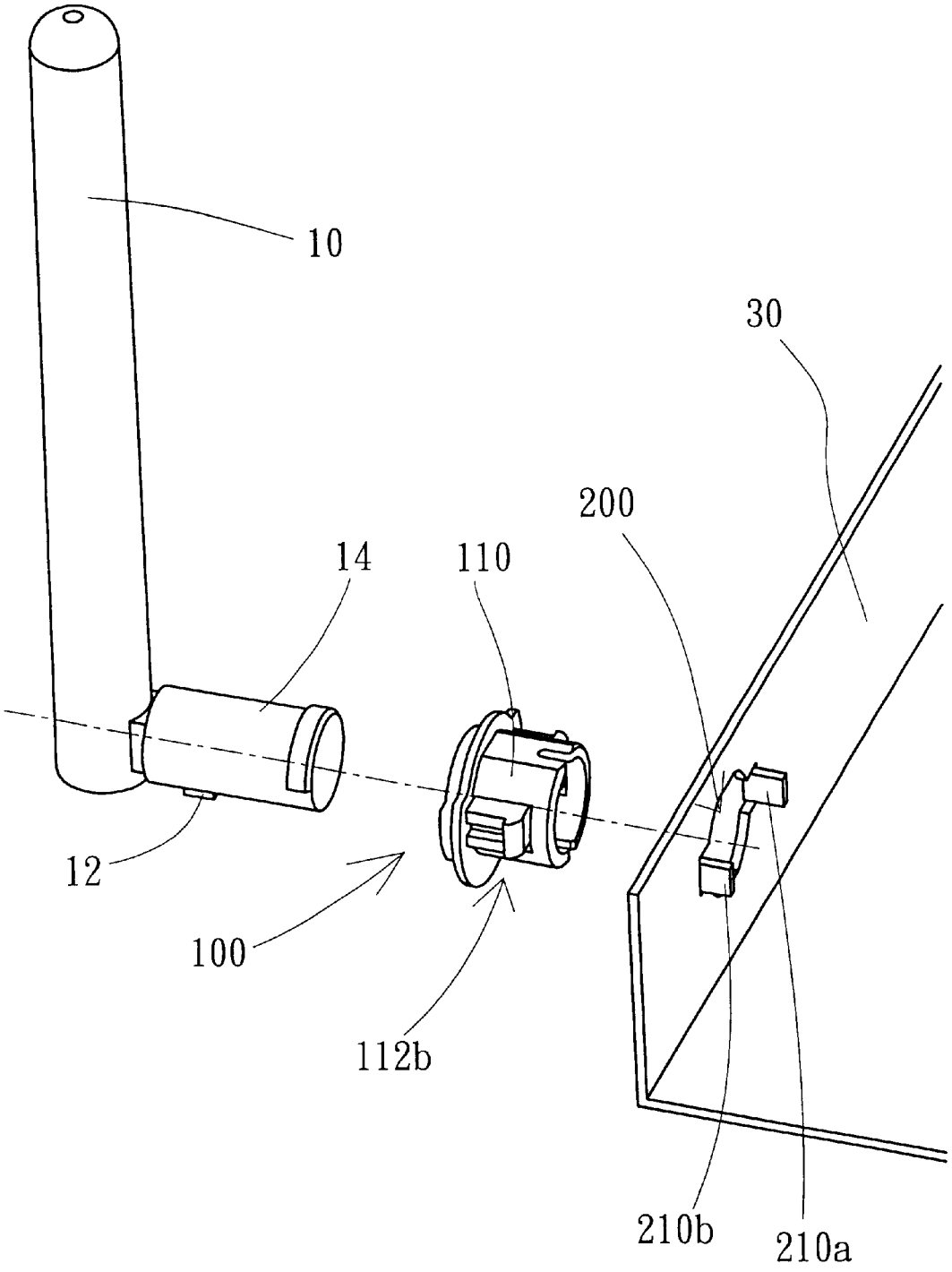
Figure 4C:
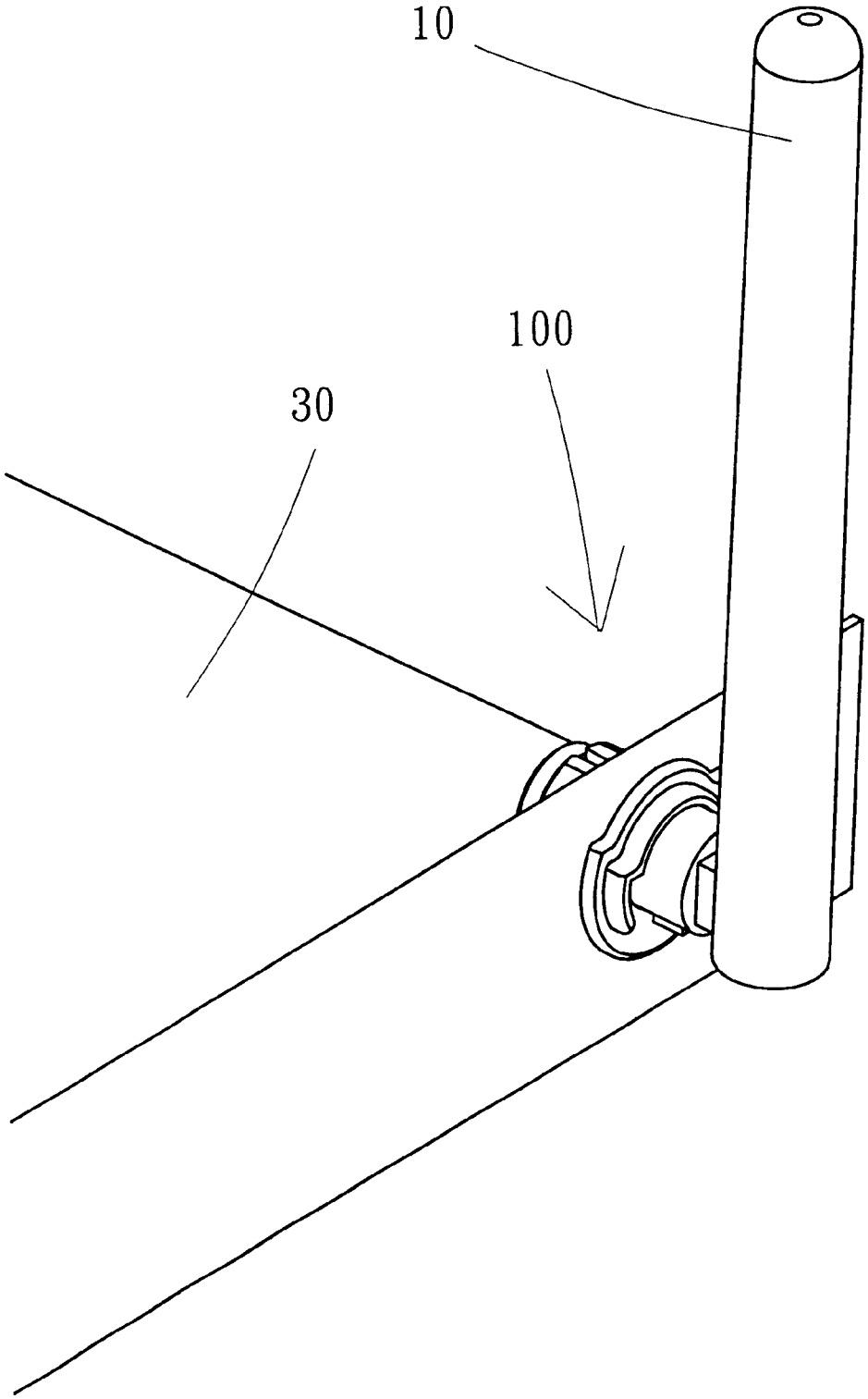

Referring to FIG. 4A, FIG. 4B and FIG. 4C, FIG. 4A, FIG. 4B and FIG. 4C are schematic diagrams showing the assembly of an antenna, an equipment housing and a modulized antenna sleeve of the preferred embodiment of the present invention, wherein FIG. 4A and FIG. 4B are viewed from different angles, and FIG. 4C is the schematic diagram showing a finished assembly. The modulized antenna sleeve 100 mainly has a tubular main body 110 and a hollow base member 120. When the modulized antenna sleeve 100 is used to fix the antenna 10 to the equipment housing 30, a base hole 200 is first formed on the sidewall of the housing 30, of the communication product, and then folded portions 210*a* and 210*b* that are opposite to each other are formed on the surrounding of the base hole 200, and thereafter, the tubular main body 110 is inserted into the base hole 200 until the clipping hook elements 112*a* and 112*b* are engaged with the folded portions 210*a* and 210*b*. Subsequently, the antenna connecting element 14 of the antenna 10 is inserted into the modulized antenna sleeve 100, wherein a rotation-blocking element 124 of the hollow base member 120 is located above the antenna connecting element 14, whereby the protrusion element 12 of the antenna connecting element 14 can be blocked by the rotation-blocking element 124 when the rotation of the antenna 10 goes beyond a certain degree of angle (for example: 180 degree), so as to prevent the antenna 10 from over-rotation, thus avoiding the entanglement of the conductive wires (not shown) connected to the antenna 10. Further, such as shown in FIG. 4C, after the modulized antenna sleeve 100 is assembled with the antenna 10 and the equipment housing 30, the total appearance thereof is quite integral, wherein no other mechanism designs exist.

Hereinafter, the related structures of the modulized antenna sleeve of the present invention will be explained in details.

Figure 5A:
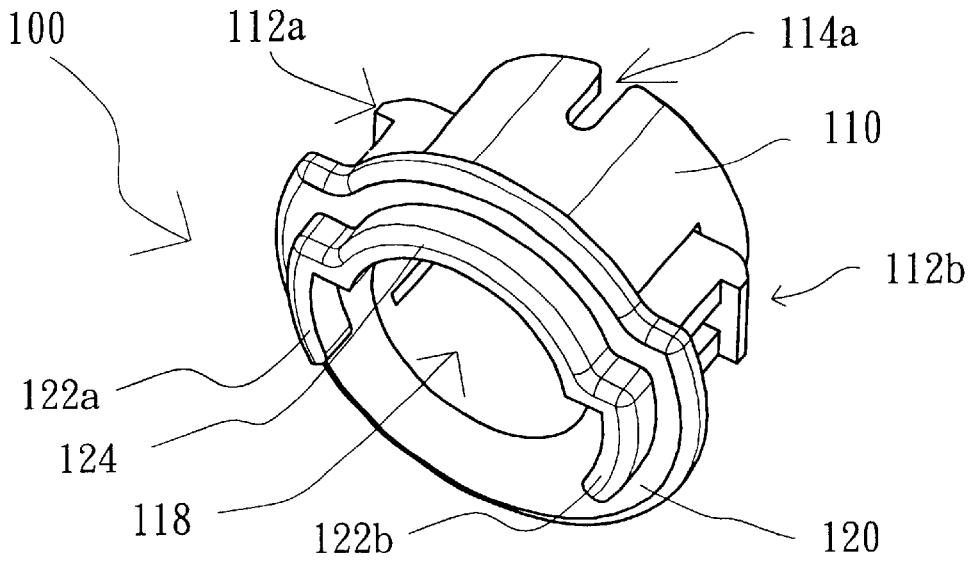
FIG. 5A and FIG. 5B are 3-D schematic diagrams showing the modulized antenna sleeve of the preferred embodiment of the present invention respectively from different angles of view.
Figure 5B:
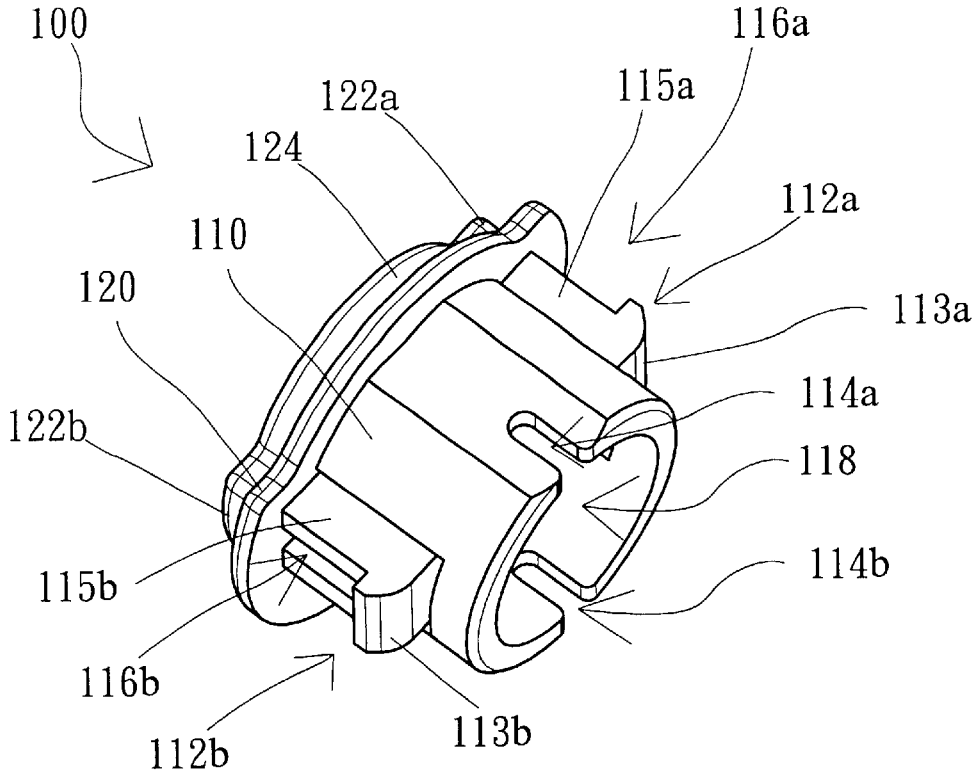

Referring to FIG. 5A and FIG. 5B, FIG. 5A and FIG. 5B are 3-D schematic diagrams showing the modulized antenna sleeve of the preferred embodiment of the present invention respectively from different angles of view. The modulized antenna sleeve 100 of the present invention comprises: the hollow base member 120 and the tubular main body 110, wherein the tubular main body 110 is located on one surface of the hollow base member 120, wherein a through hole 118 penetrates the hollow base member 120 and the tubular main body 110. A pair of clipping hook elements 112*a* and 112*b*, and a pair of notches 114*a* and 114*b* are formed the outer surface of the sidewall of the tubular main body 110. The notches 114*a* and 114*b* are formed on one end of the sidewall of the tubular main body 110 which is not adjacent to the hollow base member 120, thereby enhancing the elasticity of the tubular main body 110, so that the modulized antenna sleeve 100 of the present invention can be suitable for use in the antennas of various diameters, thus increasing the sharable possibility of the present invention.

Figure 6A:
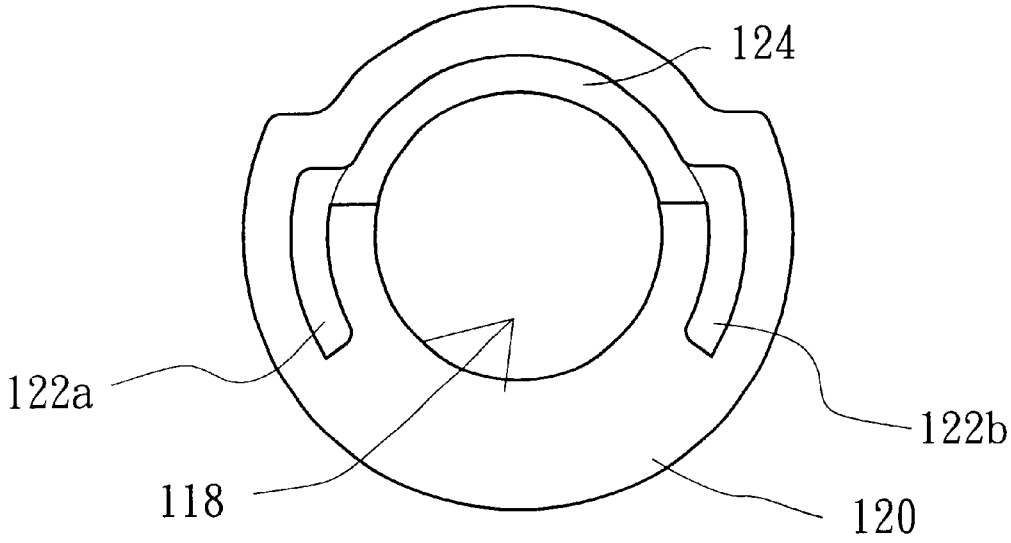
FIG. 6A and FIG. 6B are schematic diagrams respectively showing the front view and back view of the modulized antenna sleeve, according to the preferred embodiment of the present invention.
Figure 7:
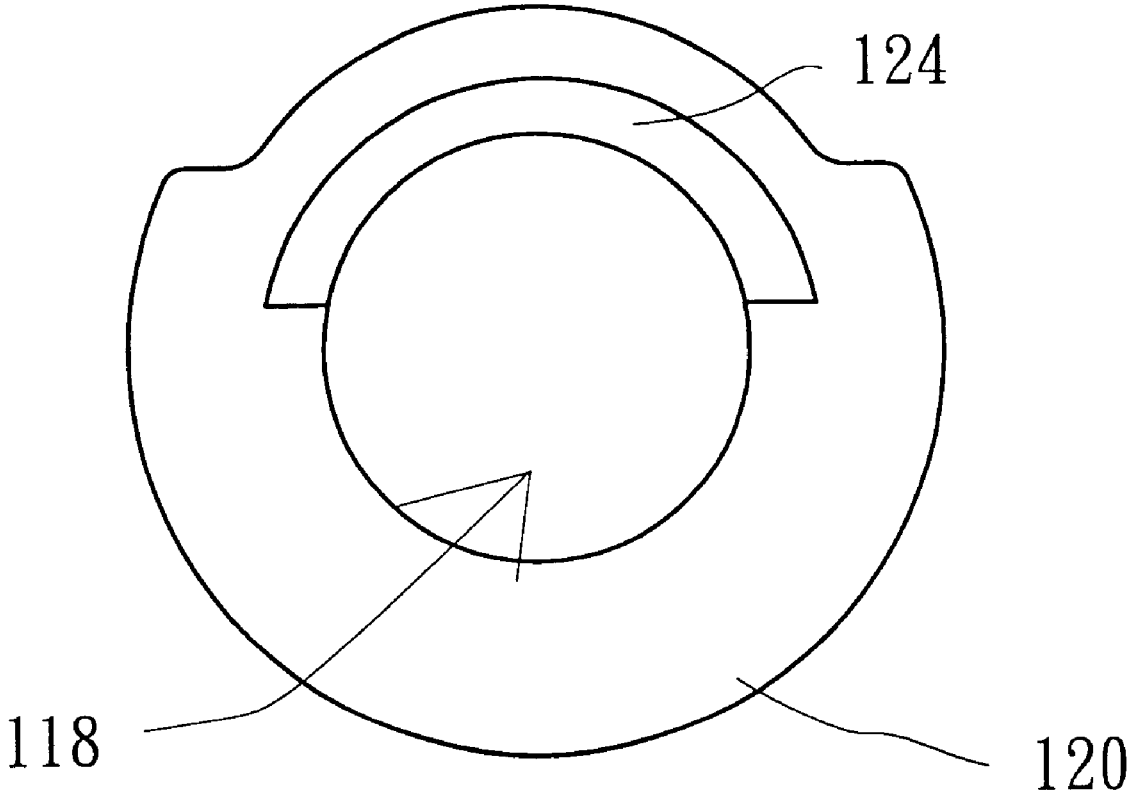
FIG. 7 is a schematic diagram showing the front view of the other modulized antenna sleeve, according to the other preferred embodiment of the present invention.

Referring to FIG. 5A and FIG. 6A, FIG. 6A is a schematic diagram showing the front view of the modulized antenna sleeve, according to the preferred embodiment of the present invention. The hollow base member 120 has a rotation-blocking element 124, and the rotation-blocking element 124 is formed on the other surface of the hollow base member 120, which is opposite to the connecting surface between the hollow base member 120 and the tubular main body 110. Just as mentioned above, the rotation-blocking element 124 is used for limiting the rotation range of the antenna. Moreover, in order to meet the requirement of product drop test, reinforcement elements 122*a* and 122*b* can be formed respectively on both ends of the rotation-blocking element 124 so as to strengthen the structure of the hollow base member 120. However, the modulized antenna sleeve 100 of the present invention also can be the structure without the reinforcement elements 122*a* and 122*b*. Referring to FIG. 7, FIG. 7 is a schematic diagram showing the front view of the other modulized antenna sleeve, according to the other preferred embodiment of the present invention, wherein the hollow base member 120 is the structure merely with the rotation-blocking element 124 and the through hole 118.

Figure 6B:
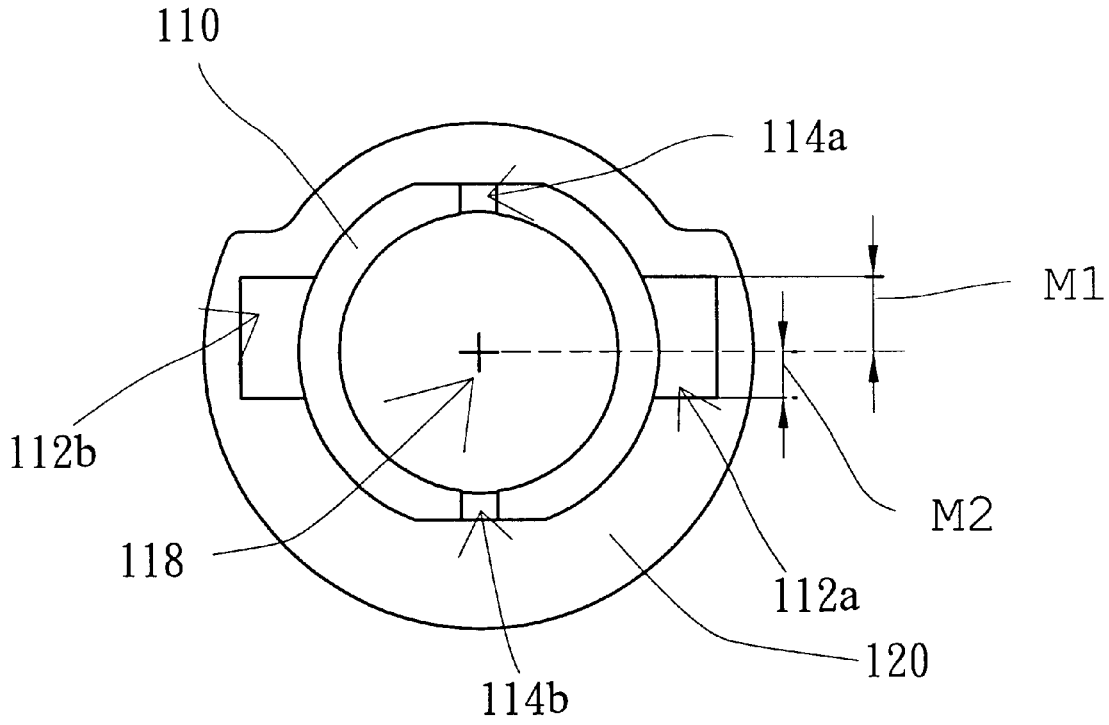
Figure 6C:
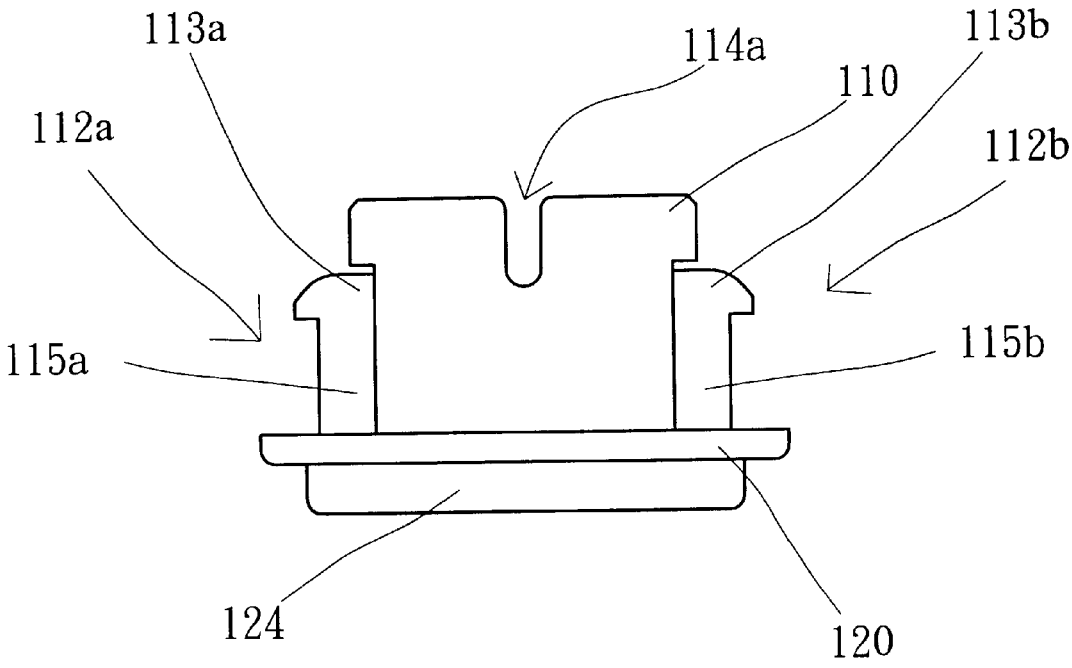
FIG. 6C is a schematic diagram showing the top view of the modulized antenna sleeve, according to the preferred embodiment of the present invention.
Figure 6D:
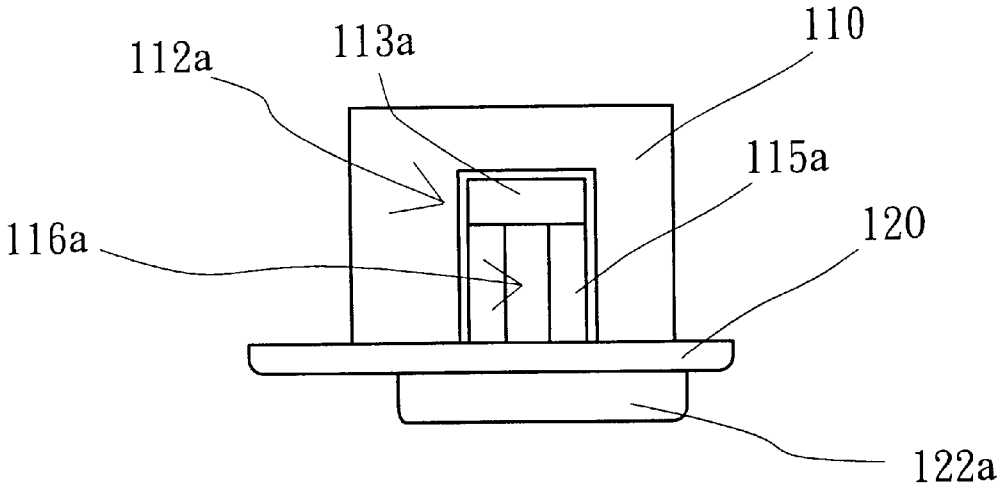
FIG. 6D is a schematic diagram showing the side view of the modulized antenna sleeve, according to the preferred embodiment of the present invention.

Referring to FIG. 5B, FIG. 6C and FIG. 6D, FIG. 6C and FIG. 6D are schematic diagrams respectively showing the top and side views of the modulized antenna sleeve, according to the preferred embodiment of the present invention. The clipping hook elements 112*a* and 112*b* on the sidewall of the tubular main body 110 correspond to at least one pair of the folded portions 210*a* and 210*b* shown in FIG. 4B, and the clipping hook element 112*a* (or 112*b*) comprises: a hook supporting portion 115*a* (or 115*b*) and a hook portion 113*a* (or 113*b*). The hook supporting portion 115*a* (or 115*b*) is located on a surface of the hollow base member 120 connecting to the tubular main body 110, and the hook portion 113*a* (or 113*b*) is located on a surface of the hook supporting portion 115*a* (or 115*b*) that is not connected to the hollow base member 120. The hook supporting portion 115*a* (or 115*b*) has a hook dividing space 116*a* (or 116*b*) used to divide the hook supporting portion 115*a* (or 115*b*) into two parts, thereby enhancing the elasticity of the hook supporting portion 115*a* (or 115*b*), so that the hook portion 113*a* (or 113*b*) can be easily engaged with the folded portions on the equipment housing without fracture.

Figure 8A:
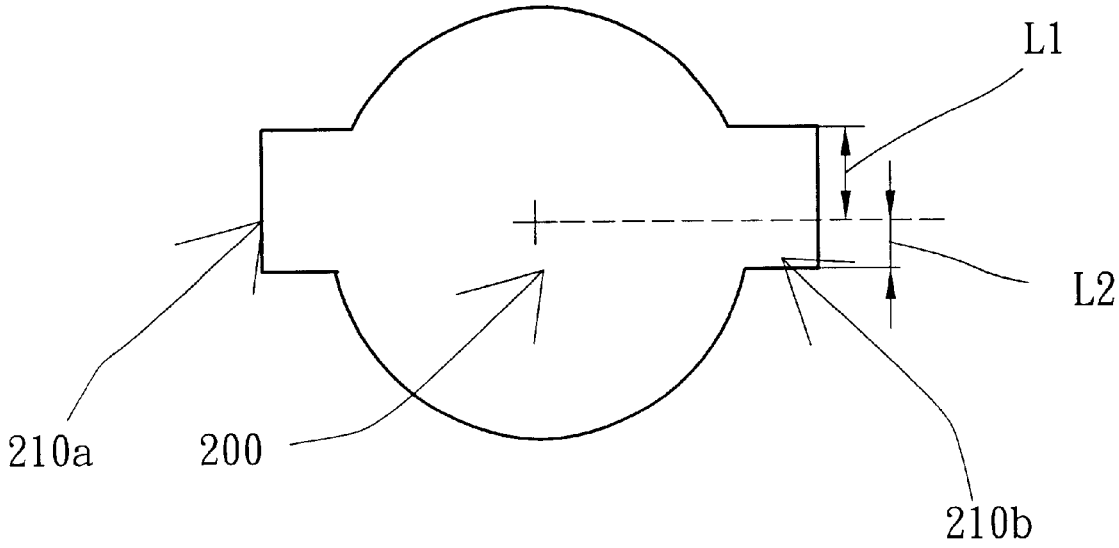
FIG. 8A is a schematic diagram showing the front view of a base hole, according to the preferred embodiment of the present invention.
Figure 8B:
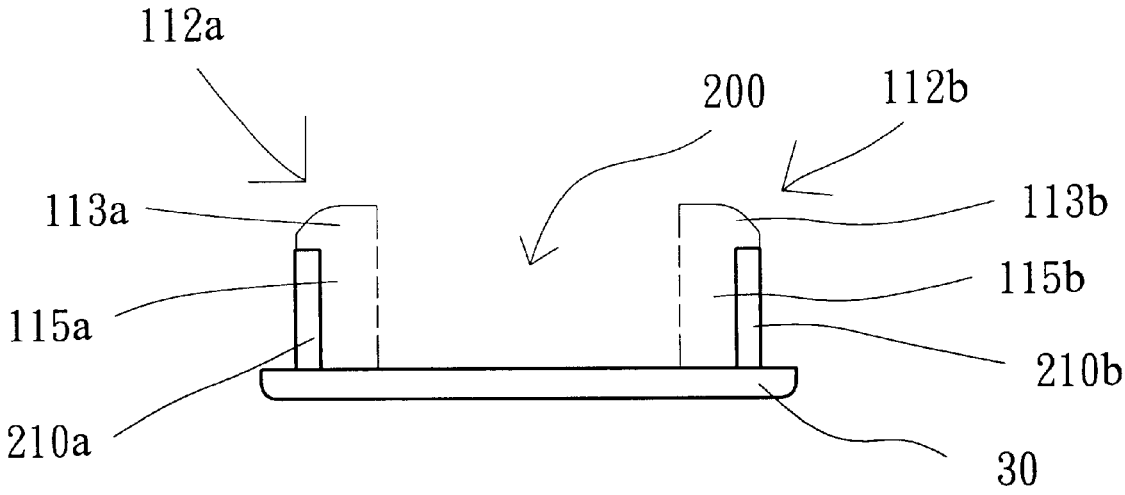
FIG. 8B is a cross-sectional schematic diagram showing the top view of a base hole, according to the preferred embodiment of the present invention.

Referring FIG. 8A and FIG. 8B, FIG. 8A and FIG. 8B are schematic diagrams showing the front and top views of a base hole, according to the preferred embodiment of the present invention. In the application of the modulized antenna sleeve of the present invention, on the sidewall of the housing of the communication product, the base hole 200 and the folded portions 210*a* and 210*b* have to be formed, wherein the hook portions 113*a* and 113*b* can be engaged with the folded portions 210*a* and 210*b*. The present invention can adjust the length of the folded portions 210*a* and 210*b* in accordance with the housing of various thickness, thus increasing the shareable possibility of the present invention. In addition, just as described above, the present invention is sharable among the antennas of various diameters, and hence, the present invention can be applied simultaneously to various antennas and housings, thus greatly reducing the production cost.

Moreover, the present invention has an idle-preventing means by using the design of asymmetry. Referring FIG. 6B and FIG. 8A, FIG. 6B is a schematic diagram showing the back view of the modulized antenna sleeve, according to the preferred embodiment of the present invention. When being disposed horizontally, the clipping hook elements 112*a* and 112*b* of the present invention are asymmetrical in shape to the horizontal central line of the through hole 118, the folded portions 210*a* and 210*b* corresponding to the clipping hook elements 112*a* and 112*b* are also asymmetrical in shape to the horizontal central line of the base hole 200. Such as shown in FIG. 6B, the distance M1 is not equal to the distance M2, and such as shown in FIG. 8A, the distance L1 is not equal to the distance L2. Hence, when the modulized antenna sleeve of the present invention is installed, the rotation-blocking element 124 as shown in FIG. 6A has be situated in a fixed direction with respect to the through hole 118 (such as above the through hole 118), or the modulized antenna sleeve cannot be inserted into the base hole 200 successfully.

It is worthy to be noted that the modulized antenna sleeve of the present invention can be made of plastic material, and the tubular main body can be a cylinder, and the through hole can be circular. However, the present invention is not limited thereto.

It is an advantage of the present invention to provide a modulized antenna sleeve having the features of high reliability, low production cost, and high sharable possibility, etc. Not only equipment housings (made of plastic or metal) of various thickness are suitable for use in applying the modulized antenna sleeve, but also the over-rotation can be prevented while the integrality of the appearance of the communication product can be still maintained.

It is the other advantage of the present invention to provide a modulized antenna sleeve, which has a simple and strong structure, and has an idle-preventing means of asymmetrical design, so that not only the installation thereof is easy, but also the requirement of the product drop test can be satisfied.

As is understood by a person skilled in the art, the foregoing preferred embodiments of the present application are illustrated of the present application rather than limiting of the present application. It is intended to cover various modifications and similar arrangements included within the spirit and scope of the appended claims, the scope of which should be accorded the broadest interpretation so as to encompass all such modifications and similar structures.

What is claimed is:

1. A modulized antenna sleeve, used for installing an antenna on a base hole of an equipment housing, wherein at least one pair of folded portions opposite to each other are formed on the surrounding of said base hole, and said modulized antenna sleeve comprises:

a hollow base member; and a tubular main body, located on a first surface of said hollow base member, wherein there is a through hole penetrating said hollow base member and said tubular main body, and the outer surface of the sidewall of said tubular main body has at least one pair of clipping hook elements corresponding to said at least one pair of folded portions respectively, each of said at least one pair of clipping hook elements comprising:

a hook supporting portion, located on said first surface of said hollow base member, and on a second surface of said tubular main body adjacent to said first surface; and a hook portion, located on the surface of said hook supporting portion that is not connected to said hollow base member, wherein said hook portion is engaged with one of said at least one pair of folded portion.

2. The modulized antenna sleeve of claim 1, comprising:

a rotation-blocking element, formed on the surface of said hollow base member opposite to said first surface, for restricting the rotation of said antenna within the range of an angle, wherein said antenna has a protrusion element, whereby said antenna stops rotating by said rotation-blocking element while being rotated towards said angle; and a pair of reinforcement elements, respectively formed on both ends of said rotation-blocking element, for strengthening the structure of said hollow base member.

3. The modulized antenna sleeve of claim 2, wherein said angle is about 180 degree.

4. The modulized antenna sleeve of claim 2, wherein said rotation-blocking element and said reinforcement elements are made of plastic material.

5. The modulized antenna sleeve of claim 2, wherein when said at least one pair of clipping hook elements are disposed horizontally, each of said at least one pair of clipping hook elements is asymmetrical in shape to the horizontal central line of said through hole, and each of said at least one pair of folded portions is also asymmetrical in shape to the horizontal central line of said through hole, whereby, while said modulized antenna sleeve is installed, said rotation-blocking element is situated in a fixed direction with respect to said through hole.

6. The modulized antenna sleeve of claim 5, wherein said fixed direction is the direction above said through hole.

7. The modulized antenna sleeve of claim 1, wherein said tubular main body has at least one pair of notches, located on one end of the sidewall of said tubular main body not connected to said hollow base member, for enhancing the elasticity of said tubular main body.

8. The modulized antenna sleeve of claim 1, wherein said hook supporting portion has a hook dividing space used for dividing said hook supporting portion into two parts, so as to enhancing the elasticity of said hook supporting portion.

9. The modulized antenna sleeve of claim 1, wherein said hollow base member, said tubular main body, and said clipping hook elements are made of plastic material.

10. The modulized antenna sleeve of claim 1, wherein said tubular main body is a cylinder, and said through hole is circular.

11. A modulized antenna sleeve, used for installing an antenna on a base hole of an equipment housing, wherein at least one pair of folded portions opposite to each other are formed on the surrounding of said base hole, and said modulized antenna sleeve comprises:

a hollow base member;

a tubular main body, located on a first surface of said hollow base member, wherein there is a through hole penetrating said hollow base member and said tubular main body, and the outer surface of the sidewall of said tubular main body has at least one pair of clipping hook elements corresponding to said at least one pair of folded portions respectively, each of said at least one pair of clipping hook elements comprising:

a hook supporting portion, located on said first surface of said hollow base member, and on a second surface of said tubular main body adjacent to said first surface; and a hook portion, located on the surface of said hook supporting portion that is not connected to said hollow base member, wherein said hook portion is engaged with one of said at least one pair of folded portion; and a rotation-blocking element, formed on the surface of said hollow base member opposite to said first surface, for restricting the rotation of said antenna within the range of an angle, wherein said antenna has a protrusion element, whereby said antenna stops rotating by said rotation-blocking element while being rotated towards said angle.

12. The modulized antenna sleeve of claim 11, wherein said angle is about 180 degree.

13. The modulized antenna sleeve of claim 11, further comprising:

a pair of reinforcement elements, respectively formed on both ends of said rotation-blocking element, for strengthening the structure of said hollow base member.

14. The modulized antenna sleeve of claim 13, wherein said reinforcement elements are made of plastic material.

15. The modulized antenna sleeve of claim 11, wherein said tubular main body has at least one pair of notches, located on one end of the sidewall of said tubular main body not connected to said hollow base member, for enhancing the elasticity of said tubular main body.

16. The modulized antenna sleeve of claim 11, wherein said hook supporting portion has a hook dividing space used for dividing said hook supporting portion into two parts, so as to enhancing the elasticity of said hook supporting portion.

17. The modulized antenna sleeve of claim 11, wherein said hollow base member, said tubular main body, and said clipping hook elements are made of plastic material.

18. The modulized antenna sleeve of claim 11, wherein said tubular main body is a cylinder, and said through hole is circular.

19. The modulized antenna sleeve of claim 11, wherein when said at least one pair of clipping hook elements are disposed horizontally, each of said at least one pair of clipping hook elements is asymmetrical in shape to the horizontal central line of said through hole, and each of said at least one pair of folded portions is also asymmetrical in shape to the horizontal central line of said through hole, whereby, while said modulized antenna sleeve is installed, said rotation-blocking element is situated in a fixed direction with respect to said through hole.

20. The modulized antenna sleeve of claim 19, wherein said fixed direction is the direction above said through hole.

* * * * *